US008875320B2

(12) United States Patent
Peñúñuri et al.

(10) Patent No.: US 8,875,320 B2
(45) Date of Patent: Nov. 4, 2014

(54) PRESSURE (SNAP-IN) FLANGE FOR INSTALLING TOILETS

(75) Inventors: Esteban Osuna Peñúñuri, Nuevo León (MX); Carlos Aceves Esquinca, Chiapas (MX)

(73) Assignee: Group Lamosa, S.A.B. DE C.V., Monterrey, Nuevo Leon (MX)

( * ) Notice: Subject to any disclaimer, the term of this patent is extended or adjusted under 35 U.S.C. 154(b) by 1047 days.

(21) Appl. No.: 12/901,826

(22) Filed: Oct. 11, 2010

(65) Prior Publication Data

US 2011/0162132 A1 Jul. 7, 2011

(30) Foreign Application Priority Data

Oct. 12, 2009 (MX) ..... MX/a/2009/010985

(51) Int. Cl.
*E03D 11/16* (2006.01)

(52) U.S. Cl.
USPC ..... 4/252.4

(58) Field of Classification Search
USPC ..... 4/252.1, 252.4–252.6
See application file for complete search history.

(56) References Cited

U.S. PATENT DOCUMENTS 1,676,276 A * 7/1928 Moore ..... 285/10
3,311,391 A * 3/1967 Harrell ..... 285/58
3,409,918 A * 11/1968 Gaddy ..... 4/252.5
3,501,172 A * 3/1970 Pickard ..... 285/59
4,185,334 A * 1/1980 Izzi ..... 4/252.2
5,937,450 A * 8/1999 Jones ..... 4/252.1
6,789,275 B2 * 9/2004 Spells et al. ..... 4/252.5
7,814,580 B2 10/2010 Coronado et al.
2008/0148469 A1 6/2008 Dipzinski et al.

FOREIGN PATENT DOCUMENTS

CA 2 664 132 3/2008

* cited by examiner

*Primary Examiner* — Huyen Le
(74) *Attorney, Agent, or Firm* — Dority & Manning, P.A.

(57) ABSTRACT

A pressure flange is provided for installing toilets. The pressure flange includes a sealing ring disposed so as to make direct contact with a bottom of a toilet base. A rigid main column is configured to connect the toilet to a sewer line in a bathroom facility, with the column having an upper tube section with a larger inner diameter section above a vertical tube section having a smaller inner diameter. The column has an oval shaped collar at a top of the upper tube section, with the collar having oppositely extending ears. A flex-line type pressure gasket is disposed around at least the vertical tube section of the column. The pressure gasket is an accordion or corrugated-type of gasket that enables the pressure flange to be fitted into the sewer line by applying downward pressure, wherein the pressure flange can be installed without the use of tools by pushing the pressure flange down into the sewer line in the bathroom and tightening and connecting the pressure flange with anchor bolts and wing nuts to a toilet base.

13 Claims, 5 Drawing Sheets

PRESSURE (SNAP-IN) FLANGE FOR INSTALLING TOILETS

FIELD OF THE INVENTION

This technical field of the present invention is bathroom fittings, and specifically the installation of toilets.

BACKGROUND INFORMATION

Common flanges in toilets (Patent: CA2664132) are made of cylindrical-shaped hard plastic with a large-diameter circular collar with ears at the top. Holes are drilled in the flange for seating the flange in the floor of the bathroom, as well as rectangular slots for special flange screws (known as anchor bolts), the threads of which point upwards, one on each side. These anchor bolts usually line up with the holes at each side of the base of the toilet. These bolts, when inserted into the seated flange, enable the toilet to be fastened to the bathroom floor by using a washer and wing nut, and tightening them around each anchor bolt on the top of the base of the toilet.

This method consists of drilling holes in the bathroom floor with a drill exactly where the holes for seating the flange are to be located, which holes were previously marked out using a pencil or marker. Anchors are inserted so that the flange can then be secured to the floor by means of lag screws and a screwdriver. A wax ring must be placed inside the flange in the main hole in the middle and at the same time as a pair of anchor bolts are inserted into the rectangular slots on each side of the flange. Toilets have an opening or outlet with a raised rim so that when the toilet is placed on the flange, the outlet with the raised rim literally flattens the wax ring inside the center hole to create a seal to prevent any leakage. This is an antiquated and messy method of doing so. When the toilet is placed on the flange, the anchor bolt threads point upwards and protrude from the base of the toilet so that it can then be fastened by means of a washer and nut around each anchor bolt using a special open-end wrench. It is important to note the different tools one must have on hand for this antiquated and traditional method of installing a toilet.

There are also flexible gaskets (US Patent Application Publication No. 2008148469), which were designed to replace plumbing wax. Since these are inserted in the space inside the flange, you must have a conventional flange if you use them. These devices also have the disadvantages of being more expensive and they may not fit certain types of toilet since they are of limited flexibility.

A flange with a flexible plastic membrane was recently introduced onto the market (Patent MX20070010443). This device is inserted in the sewer line but it follows the same antiquated method of installation, where one must drill into the bathroom floor to secure the flange to the floor, thereby damaging the floor. It also has a flexible opening that is limited to certain types of toilet outlets and it is also intended to replace a wax ring. Note that when the "flexible" membrane is inserted around sharp angles, it tends to fold and block the discharge.

SUMMARY OF INVENTION

Objects and advantages of the invention are set forth in part in the following description, or may be obvious from the description, or may be learned through practice of the invention.

PURPOSE OF INVENTION

A purpose of the invention is to enable installation of a toilet by only applying downward manual pressure. This does not cause any damage to the floor of the room and does not call for the use of special tools or equipment. The pressure flange in accordance with embodiments of the invention for installing toilets is designed to obviate the use of plumber's wax, because it uses a gasket that serves as a seal between the pressure flange and the bottom of the base of the toilet. The flange is designed so that no drilling or bolts are needed between the flange and the floor, due to the fact that it is pressure fixed to the walls of the sewer line.

The above disadvantages of prior art devices are overcome by this invention due to fact that it is durable and easy to install, inasmuch as the flange, which consists of three main parts, is pressure-secured (snap-in), and it does not damage or leave any residue on the bathroom floor; you just need your hands to install it and it seals directly to the bottom of the base of the toilet by means of a ring-type gasket; the internal diameter is big enough to fit the largest diameter specified for outlets on toilets per standards in Mexico, the United States and Canada. This invention also handles different levels or heights, which enable it to be adapted to the different depths inside the base also specified per standards in the afore-mentioned countries.

In a particular embodiment, the pressure flange consists of three basic parts; these are: the sealing ring or gasket, a rigid main column, and an external pressure gasket that fits around the rigid main column. Once the pressure flange has been connected to the toilet, these (the toilet and pressure flange assembly) work as a single unit that is inserted into the sewer line by pressing downwards, while holding on to the sides of the toilet The pressure flange is disassembled by pushing upwards in the opposite direction as the installation in order to remove the toilet and the pressure flange from their seating. This leaves you with a floor that is as clean and undamaged as the day you installed it and it also enables you to install a new toilet using the same pressure flange.

DETAILED DESCRIPTION OF INVENTION

Figure 1:
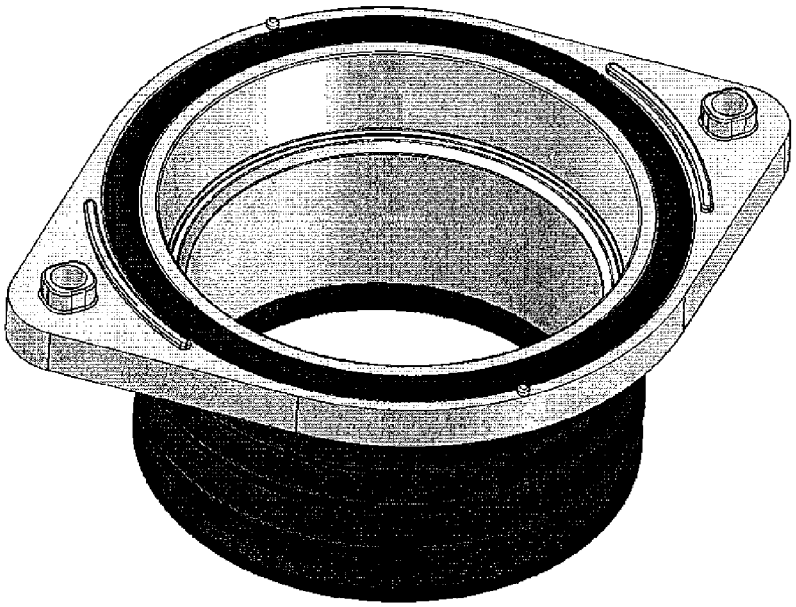
FIG. 1 is a general isometric of the pressure flange; without anchor bolts, washers and nuts.
Figure 2:
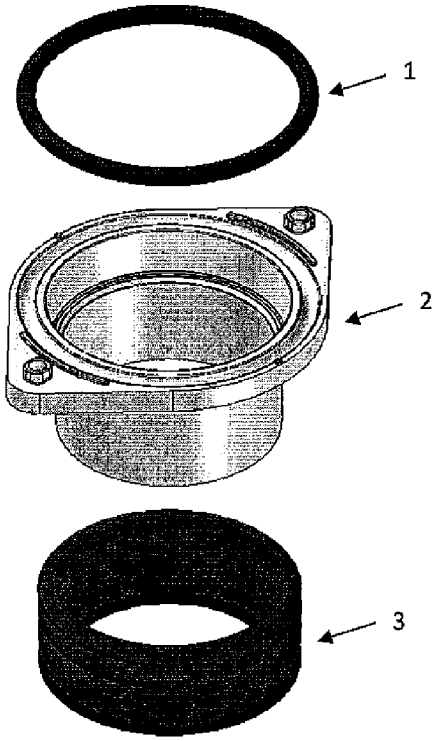
FIG. 2 is an isometric view of each individual main component of the pressure flange
Figure 3:
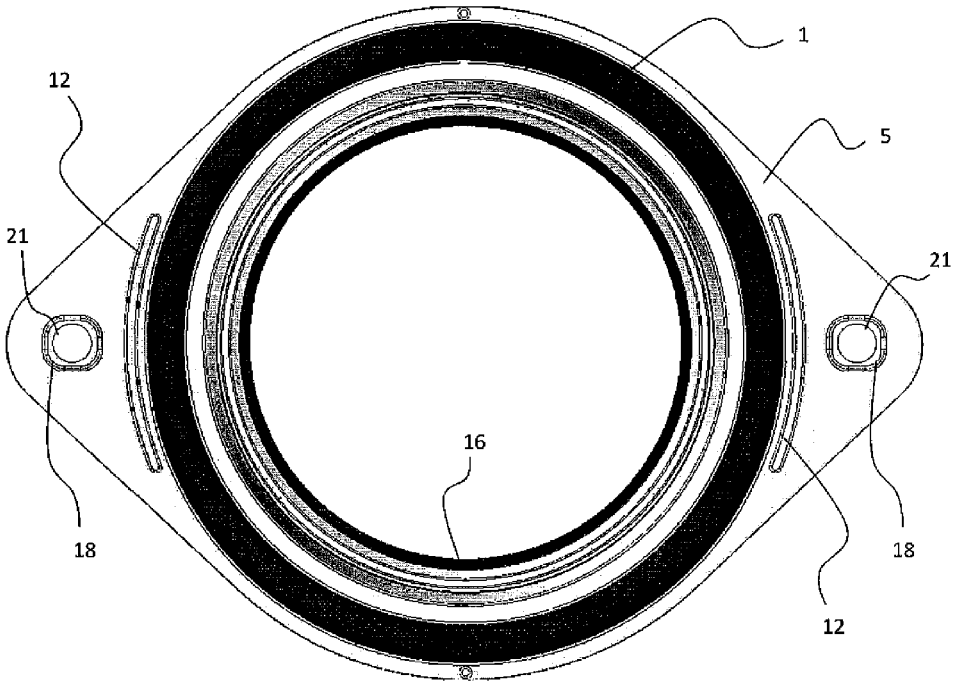
FIG. 3 is a top view of the pressure flange.
Figure 4:
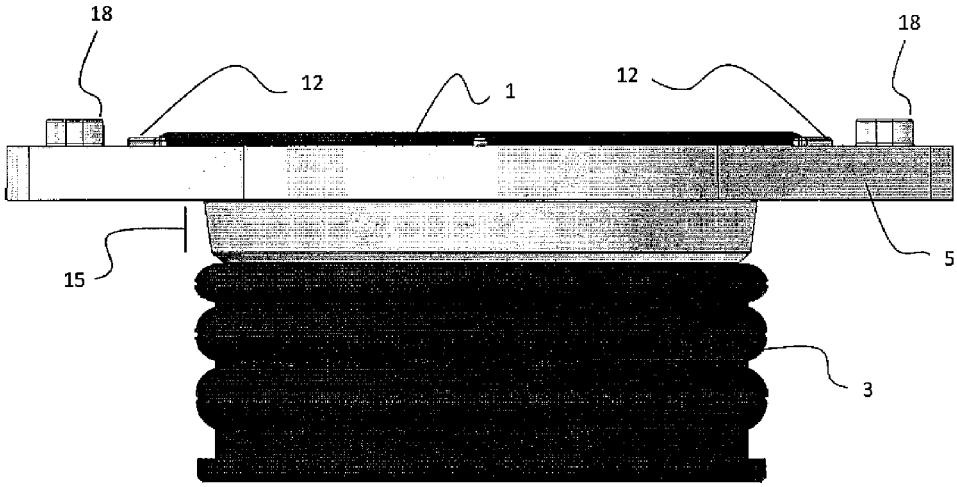
FIG. 4 is a front view of the pressure flange.
Figure 5:
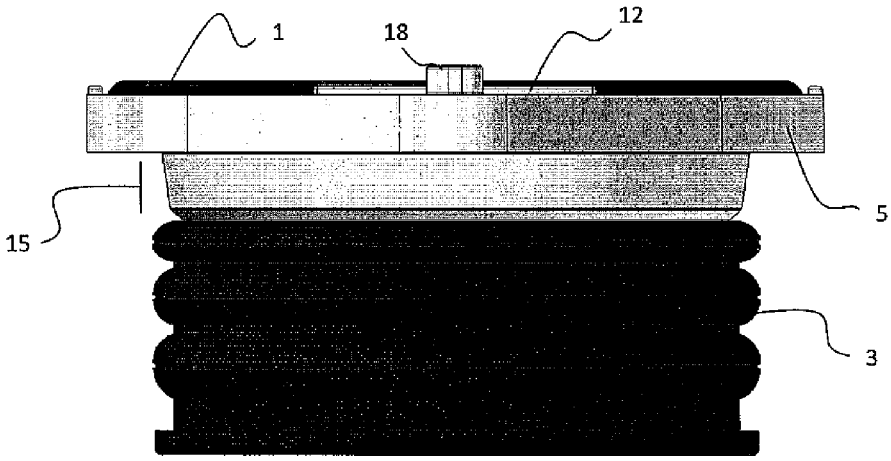
FIG. 5 is a view of the pressure flange from the right side.
Figure 6:
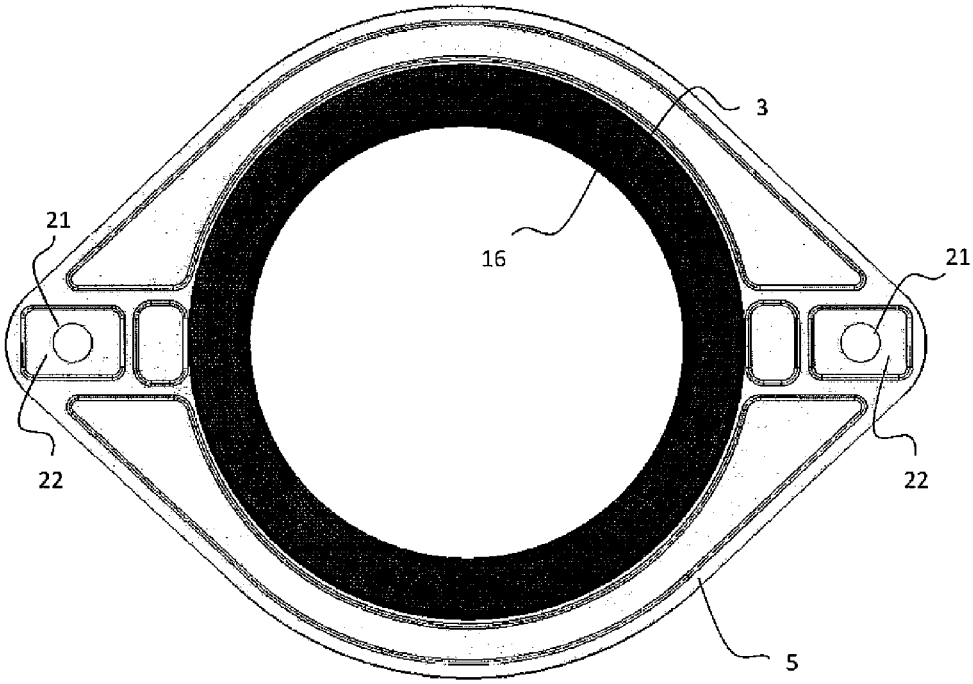
FIG. 6 is a view of the pressure flange from the bottom.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other medications and variation to the embodiments described herein.

Described is a flange for installing a toilet. Installation requires no tools—one simply applies downward pressure when inserting the flange into the sewer line. Referring to the figures in general, the flange consists of:

An o-ring seal (1) seated in the top end of a tube, which makes direct contact with the bottom of the base of the toilet in order to prevent leakage.

A rigid main column (2) for connecting and securing the toilet inside a sewer line (bathroom sewer line) (20), with a mounting which has an oval-shaped collar (5) with an ear each side with a hole in the center on the top of a vertical tube with a smaller diameter.

A pressure flex-line or ribbed seal (3) that fits around the bottom of the tube or rigid main column (2), enabling it to be inserted into the sewer line or secured by means of pressure.

Figure 8:
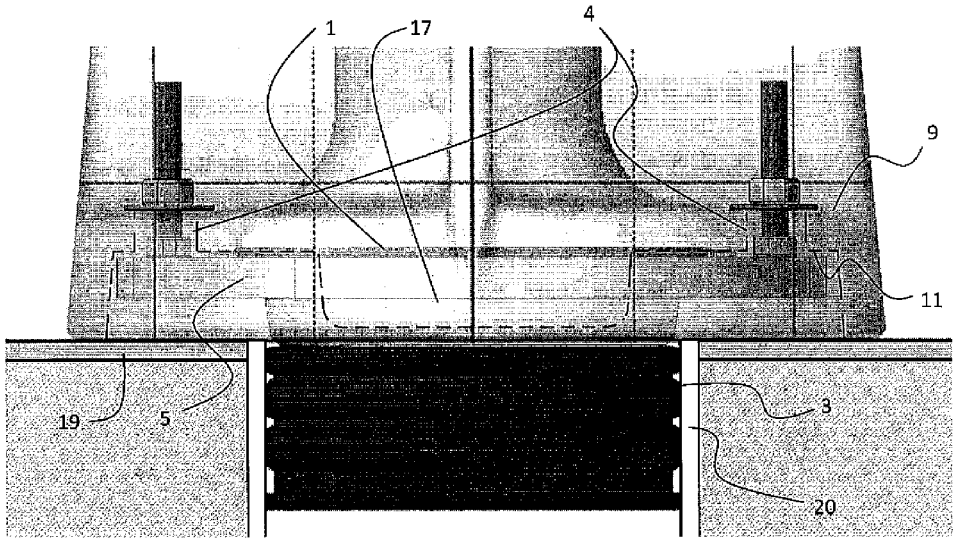
FIG. 8 is a view from the back of the completed connection—a toilet with a pressure flange connected to it inside a sewer line.
Figure 9:
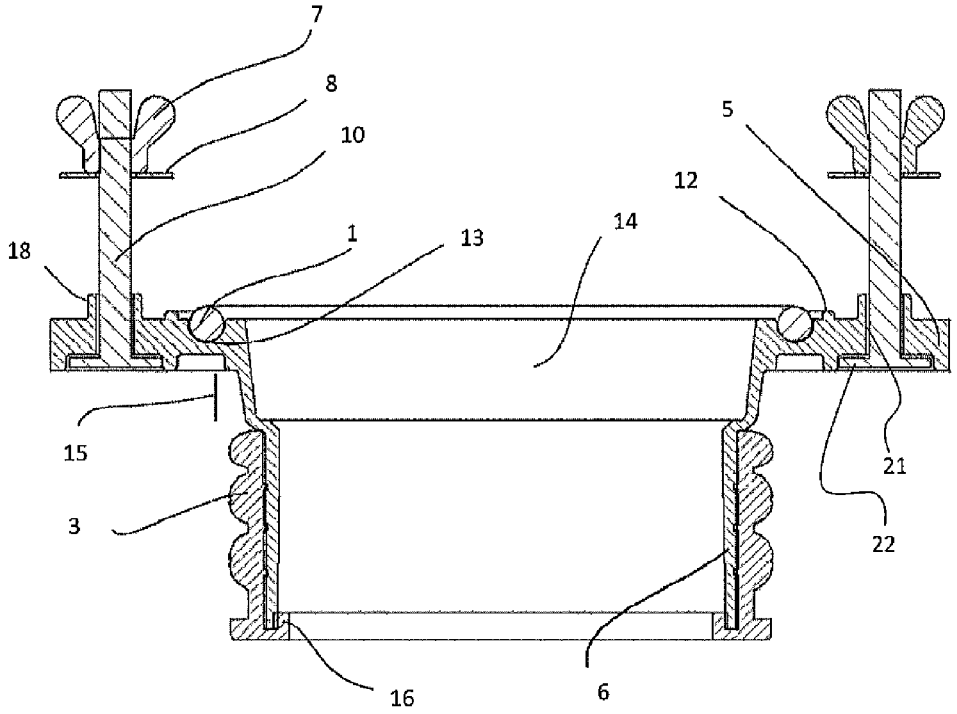
FIG. 9 is a cross-section of a front view of the pressure flange, showing its components in detail.

Toilets have two holes (4) drilled in their base (FIG. 8), one on each side of the outlet (17) enabling them to be secured to the floor (19). These same holes (4) are used to secure the pressure flange to the toilet by way of the oval-shaped top (5) and the guides (18) for the anchor bolts (10) by means of the holes (21), located one on each side, enabling the anchor bolts (10) to be connected through these holes (4) in the toilet and at the same time the oval-shaped top (5), which has a circular down pipe (6) in the center; this provides it with access to the sewer line (20) in the room.

Once the pressure flange has been connected and secured to the toilet, the water outlet opening with the raised rim (17) in the toilet is inside the pressure flange in the inside (14) of the pressure flange, which is specially designed for this feature of the toilet. This internal space (14) is big enough to fit all diameters and water outlet heights in toilets per national and foreign standards.

The pressure flange is shaped like a vertical tube and it is designed to be connected directly to the toilet, whereby one simply tightens the wing nuts (7) down onto the washers by hand (8) on the top of the base (9) of the toilet. Also there is enough space (14) inside this flange to fit different diameters and water outlet heights in toilets. When the anchor bolts (10) are tightened, the anchor on the anchor bolt locks into the pressure flange from the base of the oval collar at the top (5) in the special cavities (22) for the anchors, which in turn pushes the sealing o-ring (1). This ring is preferably ring-shaped and made of rubber and gives a good seal and connection to the bottom of the base (11) of the toilet. The curved stops (12) around the ring-shaped cavity (13) that secures the sealing o-ring (1) allows the sealing o-ring (1) to fulfill its function as a seal without forcing or altering the oval collar (5) at the top of the pressure flange. This o-ring (1) can easily be replaced if required, so the life cycle of the product is extended.

Figure 7:
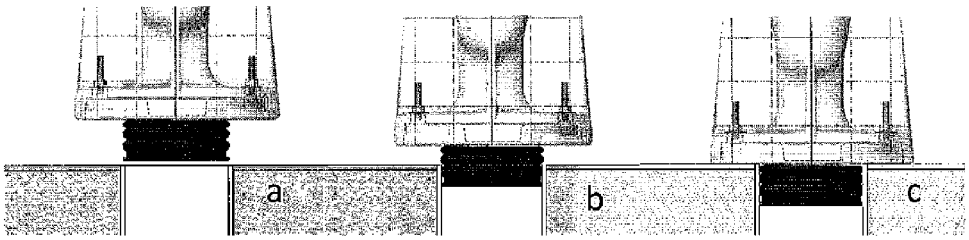
FIG. 7 consists of three consecutive views from the back (a, b and c), illustrating the procedure for inserting an assembled pressure flange into a toilet, inside the bathroom sewer line.

FIG. 7 shows how, once the pressure flange has been connected to the toilet, the toilet and pressure flange become a single unit ready for connection to the sewer line (2) in the room. The connection method is shown in FIG. 7, where the toilet with the pressure flange is seated just above the sewer line hole (20), as shown in illustration (a) in the series of illustrations in FIG. 7. The entire toilet is then pushed down until the base of the toilet is resting on the bathroom floor (19), as shown in illustration (b) in FIG. 7, until the pressure flange has been completely inserted into the sewer line (20), as shown in illustration (c).

The extension (15) located between the circular tube (6) in the middle of the flange and the oval upper part of the base (5) means that the pressure flange can be adapted to toilet bases of different depths (11).

The exterior corrugated ring (3), which should preferably be made of flexible PVC, is fitted with a lip (16) going all around the center tube (6) in the rigid main column (2)—preferably made of PVC—of the pressure flange. The function of this exterior pressure ring is to apply uniform pressure right across the contact surface it has with the walls of the sewer line (20). There is a special hole for anchor bolts (10) on each side of the oval-shaped collar (5) and also a ring-shaped cavity just around the hole in the center of the oval, where the sealing ring (1) is attached. The center circular tube keeps the exterior pressure gasket upright and in the same position for insertion, without folding. The pressure exerted by the exterior pressure gasket on the walls of the sewer line (20) enable the toilet to be secured to the floor so that any horizontal or vertical movement thereof is limited to a certain range. The exterior pressure gasket (3) is corrugated or ribbed; this means that it can be slipped or inserted into the sewer line (20) because it has air inside it and at the same time it presses against the inside wall of the sewer line (20).

Another installation method using a pressure flange is to first insert the pressure flange into the sewer line (20) and then sit the toilet on top of the flange, line up the holes in the base (4), and then tighten the washers (8) and wing nuts (7) by hand to the top of the base (9) of the toilet.

To replace the toilet, the only thing to do is pull the toilet straight up by holding the toilet on each side in order to remove it.

Modifications and variations can be made to the embodiments illustrated or described herein without departing from the scope and spirit of the invention as set forth in the appended claims.

The invention claimed is:

1. A pressure flange for installing toilets comprising:

a sealing ring disposed so as to make direct contact with a bottom of a toilet base;

a rigid main column configured to connect the toilet to a sewer line in a bathroom facility, the column having an upper tube section with a larger inner diameter section above a vertical tube section having a smaller inner diameter;

the column having an oval shaped collar at a top of the upper tube section, the oval shaped collar having oppositely extending ears;

a flex-line type pressure gasket disposed around at least the vertical tube section of the column, the pressure gasket comprising an accordion or corrugated-type of gasket that enables the pressure gasket to be fitted into the sewer line by applying downward pressure, wherein the pressure gasket further comprises a bottom lip that extends below and engages a bottom edge of the vertical tube section to prevent the pressure gasket from slipping when inserting the pressure flange into the sewer line; and wherein the pressure flange can be installed without the use of tools by pushing the pressure flange down into the sewer line in the bathroom and tightening and connecting the pressure flange with anchor bolts and wing nuts to a toilet base.

2. The pressure flange for installing toilets as in claim 1, wherein the upper tube section and vertical tube section are defined in a common tubular component, the oval shaped collar disposed above the tubular component.

3. The pressure flange for installing toilets as in claim 1, wherein the sealing ring is made of rubber and is disposed in a ring-shaped cavity defined in a top of the oval shaped collar around an opening to the upper tube section.

4. The pressure flange for installing toilets as in claim 3, further comprising curved stops located radially outward of the ring-shaped cavity such that the sealing ring seals against the toilet base without forcing or altering the structure of the pressure flange.

5. The pressure flange for installing toilets as in claim 1, wherein the pressure flange is connected to the toilet, thereby making the toilet and the pressure flange become a single unit prior to pressing the pressure flange into the sewer line.

6. The pressure flange for installing toilets as in claim 1, wherein the pressure gasket is preferably made of flexible corrugated or ribbed PVC, enabling it to be slid or inserted into the sewer line.

7. The pressure flange for installing toilets as in claim 1, further comprising anchor bolt guides in the ears of the oval shaped collar.

8. The pressure flange for installing toilets as in claim 1, wherein the main column is configured to be pressed into a rigid circular down pipe that accesses the sewer line.

9. The pressure flange for installing toilets as in claim 1, further comprising a ring-shaped cavity defined in a top of the oval shaped collar around an opening to the upper tube section, and anchor bolt holes defined in the ears of the oval shaped collar radially outward of the ring-shaped cavity.

10. The pressure flange for installing toilets as in claim 1, wherein the upper tube section has an inner diameter with sufficient space to accommodate toilets with varying water outlet diameters and water outlet heights in standard toilets.

11. The pressure flange for installing toilets as in claim 10, wherein the upper tube section has an extension length between the oval shaped collar and the vertical tube section to accommodate toilets with varying water outlet depths.

12. A pressure flange for installing toilets comprising:

a sealing ring disposed so as to make direct contact with a bottom of toilet base;

a rigid main column configured to connect the toilet to a sewer line in a bathroom facility, the column having an upper tube section with a larger inner diameter section above a vertical tube section having a smaller inner diameter;

the column having an oval shaped collar at a top of the upper tube section, the oval shaped collar having oppositely extending ears;

a flex-line type pressure gasket disposed around at least the vertical tube section of the column, the pressure gasket comprising an accordion or corrugated-type of gasket that enables the pressure gasket to be fitted into the sewer line by applying downward pressure, wherein the pressure gasket further comprises a bottom lip that extends below and engages a bottom edge of the vertical tube section to prevent the pressure gasket from slipping when inserting the pressure flange into the sewer line;

wherein the pressure flange can be installed without the use of tools by pushing the pressure flange down into the sewer line in the bathroom and tightening and connecting the pressure flange with anchor bolts and win nuts to a toilet base; and wherein the bottom lip of the pressure gasket extends radially into the vertical tube section and engages against an inner wall of the vertical tube section to further prevent the pressure gasket from slipping when inserting the pressure flange into the sewer line.

13. The pressure flange for installing toilets as in claim 12, wherein the pressure gasket has a top end engaged against the upper vertical section of the main column which allows the exterior gasket to stay upright without folding and in the correct position when inserting it into the sewer line.

* * * * *